United States Patent [19]

Ishimaru

[11] 4,231,003

[45] Oct. 28, 1980

[54] SHIELD-TYPE COAXIAL VACUUM FEEDTHROUGH

[75] Inventor: Hajime Ishimaru, Ibaraki, Japan

[73] Assignee: The Director-General of National Laboratory for High Energy Physics, Ibaraki, Japan

[21] Appl. No.: 971,540

[22] Filed: Dec. 20, 1978

[30] Foreign Application Priority Data

Dec. 21, 1977 [JP] Japan ..... 52-153866

[51] Int. Cl.[3] ..... H01P 1/04; H01P 5/00

[52] U.S. Cl. ..... 333/33; 333/244; 333/260; 339/94 A

[58] Field of Search ..... 333/33, 244, 260; 339/60 C, 94 A, 94 R, 126 J

[56] References Cited

U.S. PATENT DOCUMENTS 2,992,407 7/1961 Slusher ..... 333/244

3,292,117 12/1966 Bryant et al. ..... 333/260

3,760,306 9/1973 Spinner et al. ..... 333/33 X

*Primary Examiner*—Paul L. Gensler

*Attorney, Agent, or Firm*—Robert E. Burns; Emmanuel J. Lobato; Bruce L. Adams

[57] ABSTRACT

A shield-type coaxial vacuum feedthrough for connecting an external wire to electric equipment inside a vacuum vessel, comprising a metal pin in the shape of a metal round bar, a ceramic cylinder enclosing the metal pin and a metal cylinder enclosing the ceramic cylinder, with the ceramic cylinder being partly enlarged in diameter so as to peripherally contact and fix itself to the metal cylinder, and the metal pin being reduced in diameter in that part corresponding to the enlarged part of the ceramic cylinder. Thereby, the matching of characteristic impedance can be secured even in the high-frequency region such as microwaves thereby allowing high-accuracy experiments and insuring strong endurance during the baking of the vacuum vessel.

4 Claims, 1 Drawing Figure

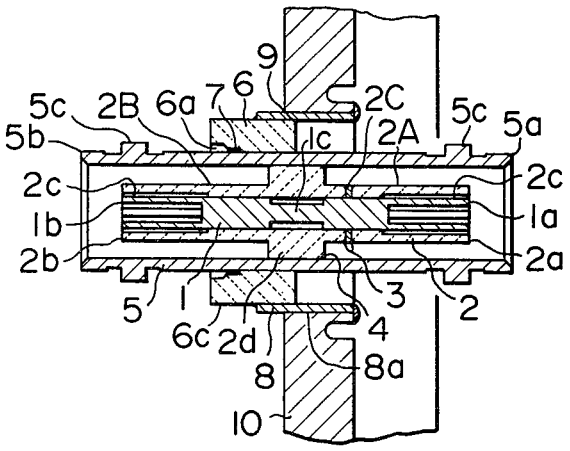
9
6
7
6a
2B
5c
5b
2C
1c
2A
5c
5a
2c
1b
2b
2c
1a
2a
5
1
3
2
6c
2d
4
8
8a
10

SHIELD-TYPE COAXIAL VACUUM FEEDTHROUGH

BACKGROUND OF THE INVENTION

This invention relates to a coaxial vacuum feedthrough that is used for connecting an external wire to electric equipment inside a vacuum vessel. More particularly, it relates to a shield-type coaxial vacuum feedthrough that permits delivering high-frequency signals, such as microwaves, to electric equipment inside a vacuum vessel such as an accelerator.

Generally, a coaxial feedthrough is used to send high-frequency current into and out of electric equipment. A conventional general-purpose coaxial feedthrough of this type comprises a pin of metal in the shape of a round bar which is enclosed with a shielding cylinder of synthetic resin such as ethylene tetrafluoride, then enclosed with a metal cylinder. In baking a vacuum vessel, for the purpose of evacuation, fitted with such a coaxial feedthrough, a noxious gas may develop, and flow into the vessel, as the vessel wall becomes heated.

This problem may appear to be solved by changing the material of the shielding cylinder from synthetic resin to ceramic, while leaving the metal round-bar pin and cylinder unchanged. But, in reality, this method changes the characteristic impedance of the feedthrough because of the difference in dielectric constant between synthetic resin and ceramic. Then the characteristic impedance of the feedthrough cannot be matched with that of a coaxial cable that is to be coupled therewith, especially in the high-frequency region.

SUMMARY OF THE INVENTION

This invention offers an effective solution to this problem. The object of this invention is to provide a shield-type coaxial vacuum feedthrough that can withstand the baking of the vacuum vessel and whose characteristic impedance is so matched as to permit good in-and-out delivery of such high-frequency signals as microwaves.

To attain this object, a shield-type coaxial vacuum feedthrough according to this invention comprises a pin of metal in the shape of a round bar, a ceramic cylinder enclosing the metal pin and a metal cylinder enclosing the ceramic cylinder, with part of the ceramic cylinder being enlarged in diameter to contact and fix itself to the metal cylinder and that part of the metal pin which corresponds to the enlarged part of the ceramic cylinder is reduced in diameter to match the characteristic impedance of this part of the feedthrough to the characteristic impedance of adjacent parts of the feedthrough.

With this shield-type coaxial vacuum feedthrough, having the partly enlarged ceramic cylinder fixing to the metal cylinder and the correspondingly reduced metal pin, the matching of characteristic impedance can be secured even in the high-frequency region. This feedthrough not only permits performing high-accuracy experiments, but also withstands the high temperature involved in the baking of the vacuum vessel.

DESCRIPTION OF THE PREFERRED EMBODIMENT

Now, a shield-type coaxial vacuum feedthrough embodying this invention will be described by reference to the accompanying drawing. The FIGURE is a longitudinal cross-section of the embodiment. A pin 1 of metal round bar is made of an alloy of iron, nickel, cobalt, etc., such as Koval (trademark). The vacuum-side end 1*a* and the atmosphere-side end 1*b* thereof are centrally bored, and divided into four parts to impart elasticity.

The pin 1 is enclosed with a first ceramic cylinder 2 made of alumina procelain and comprising a vacuum-side cylinder 2A and an atmosphere-side cylinder 2B. In other words, the first ceramic cylinder 2 is composed of the cylinders 2A and 2B that are coupled together with a washer 2C of such metal as Koval (trademark) therebetween.

This first ceramic cylinder 2 airtightly fixes to the pin 1 at a first fixing point 3 near where the cylinders 2A and 2B are coupled together. At both ends 2*a* and 2*b* thereof, the first ceramic cylinder 2 provides a suitably deep relief groove 2*c* between itself and the pin 1.

The first ceramic cylinder 2 has a larger-diameter part 2*d* at about the middle thereof, which airtightly fixes to a first metal cylinder 5 at a second fixing point 4 axially spaced from the first fixing point 3.

The first metal cylinder 5 also is made of Koval (trademark) or other similar material. The vacuum- and atmosphere-side ends 5*a* and 5*b* thereof each have two bosses 5*c* to permit connection to a BNC plug.

The metal pin 1 has a smaller-diameter part 1*c* in a position corresponding to the larger-diameter part 2*d* of the first ceramic cylinder 2. This permits matching the characteristic impedance of the area corresponding to the larger-diameter part 2*d* to that of the adjacent area.

The pin 1 and the first metal cylinder 5 should be made to their conventional size to permit coupling this feedthrough with a BNC plug. Also, the thickness of the first ceramic cylinder 2 should be reduced to secure impedance matching between the feedthrough and a coaxial cable (not shown) to be coupled therewith while maintaining the conventional size of the pin 1 and the first metal cylinder 5. Finally, the first ceramic cylinder 2 should have a larger-diameter part 2*d*, the periphery of which contacts the first metal cylinder 5, to achieve vacuum sealing.

When the larger-diameter part 2*d* is formed on the first ceramic cylinder 2, the characteristic impedance of the position corresponding to the larger-diameter part 2*d* becomes unmatched with that of the adjacent part. The characteristic impedance of a coaxial cable or feedthrough depends not only on the dielectric constant of the shielding material contained therein, but also on the diameter of the inside conductor (the pin 1) and other factors. Accordingly, the characteristic impedance of the position corresponding to the larger-diameter part 2*d* can be matched to that of the adjacent part, i.e., the coaxial cable coupled to the feedthrough, by suitably changing the diameter of the pin 1 in accordance with the varying thickness of the first ceramic cylinder 2.

If the pin 1 has the same diameter throughout the entire length thereof, the position corresponding to the larger-diameter part 2*d* of the first ceramic cylinder 2 has a smaller characteristic impedance than the adjacent area. By reducing the diameter of that part of the pin 1 which corresponds to the larger-diameter part 2*d*, the characteristic impedance can be equalized in both areas, or matched as a whole.

A second ceramic cylinder 6 of alumina procelain air-tightly fixes to the outside of the first metal cylinder 5, at a third fixing point 7 axially departing or spaced from the first and second fixing points 3 and 4.

A relief groove 6a is formed on the inside of the second ceramic cylinder 6, in the vicinity of the third fixing point 7. If necessary, a relief groove may be formed in the opposite position.

A second metal cylinder 8 of Koval (trademark) etc. airtightly fixes to the outside of the second ceramic cylinder 6, at a fourth fixing point 9 axially departing or spaced from the first, second and third fixing points 3, 4 and 7.

The second ceramic cylinder 6 exposes its external surface 6c to the atmosphere, adjacent to the fourth fixing point 9.

The end 8a of the outermost second metal cylinder 8 airtightly fixes to a vacuum vessel 10, projecting beyond the second ceramic cylinder 6 toward the vacuum vessel 10.

Both ends 1a and 1b of the pin 1 may be divided into four parts, and held within the first metal cylinder 5. Or, either or both of the ends 1a and 1b may project from the first metal cylinder 5 for coupling with a connector of an amplifier or other equipment.

A plurality of larger-diameter parts may be formed on the first ceramic cylinder 2; then the diameter of the pin 1 should be reduced correspondingly.

In the shield-type coaxial vacuum feedthrough of this invention, as described above, the larger-diameter part 2d of the first ceramic cylinder 2 fixes to the first metal cylinder and the smaller-diameter part 1c of the metal pin 1 corresponds in position to said larger-diameter part 2. Consequently, the characteristic impedance of the area corresponding to the larger-diameter part 2d can be matched to that of the adjacent part, which permits microwaves up to approximately 4GHz to be sent in and out of the vacuum vessel 10 with high accuracy.

Being capable of sending such high-frequency signals as microwaves into and out of the vacuum vessel, the shield-type coaxial vacuum feedthrough of this invention permits easy and accurate performance of various experiments in many areas of research, including the study of the instability of proton synchrotron beams and the beam monitoring of electron linear accelerators and storage rings.

What is claimed is:

1. A shield-type coaxial vacuum feedthrough comprising a pin of metal round bar, a first ceramic cylinder enclosing the metal pin, a first metal cylinder enclosing the first ceramic cylinder, a second ceramic cylinder enclosing the first metal cylinder, and a second metal cylinder enclosing the second ceramic cylinder, the first ceramic cylinder air-tightly fixing to the metal pin at a first fixing point and to the first metal cylinder at a second fixing point axially departing from the first fixing point, the second ceramic cylinder airtightly fixing to the first metal cylinder at a third fixing point axially departing from the first and second fixing points and to the second metal cylinder at a fourth fixing point axially departing from the first, second and third fixing points, wherein the first ceramic cylinder has a larger-diameter part fixing to the first metal cylinder and the metal pin has a smaller-diameter part in a position corresponding thereto so that the characteristic impedance of the area corresponding to the larger-diameter part is matched with the characteristic impedance of the adjacent area.

2. A shield-type coaxial vacuum feedthrough according to claim 1, wherein the second ceramic cylinder has a peripheral surface that is exposed to the atmosphere adjacent to the fourth fixing point and the second metal cylinder has an end protruding beyond the second ceramic cylinder toward a vacuum vessel and airtightly fixing thereto.

3. A shielded coaxial vacuum feedthrough, comprising: a round metallic pin; a first ceramic cylinder coaxial with and surrounding a side surface portion of said metal pin; a first metallic cylinder coaxial with and surrounding a side surface portion of said first ceramic cylinder; a second ceramic cylinder coaxial with and surrounding a side surface portion of said first metallic cylinder; and a second metallic cylinder coaxial with and surrounding a side surface portion of said second ceramic cylinder; said first ceramic cylinder hermetically sealed to said metallic pin at a first position and hermetically sealed to said first metallic cylinder at a second position axially spaced from said first position; said second ceramic cylinder hermetically sealed to said first metallic cylinder at a third position axially spaced from said first and second positions and hermetically sealed to said second metallic cylinder at a fourth position axially spaced from said first, second and third positions; said first ceramic cylinder having a large-diameter portion equal to an inner diameter of said first metallic cylinder for fixing said first ceramic cylinder within said first metallic cylinder; and said metallic pin having a small-diameter portion at the same axial position as said large diameter portion of said first ceramic cylinder for matching a characteristic impedance of the portion of the feedthrough at said large-diameter portion of said first ceramic cylinder with adjacent portions of the feedthrough.

4. A shielded coaxial vacuum feedthrough according to claim 3, wherein a portion of said second ceramic cylinder extends beyond said second metallic cylinder in one axial direction of the feedthrough, and a portion of said second metallic cylinder extends beyond said second ceramic cylinder in the opposite axial direction of the feedthrough.

* * * * *